US006437677B1

(12) United States Patent
Takeuchi et al.

(10) Patent No.: US 6,437,677 B1
(45) Date of Patent: Aug. 20, 2002

(54) MULTI-LAYERED INDUCTOR ARRAY

(75) Inventors: Hiroyuki Takeuchi, Shiga-ken; Naotaka Oiwa, Yokaichi; Motoi Nishii, Omihachiman, all of (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/672,744

(22) Filed: Sep. 28, 2000

(30) Foreign Application Priority Data

Sep. 28, 1999 (JP) ..... 11-275023

(51) Int. Cl.[7] ..... H01F 5/00
(52) U.S. Cl. ..... 336/200; 336/223; 336/232
(58) Field of Search ..... 336/200, 232, 336/223; 29/602.1, 606

(56) References Cited

U.S. PATENT DOCUMENTS 5,850,682 A * 12/1998 Ushiro ..... 29/608
6,191,667 B1 * 2/2001 Takenaka et al. ..... 333/185

FOREIGN PATENT DOCUMENTS

JP 11-16738 * 1/1999 ..... 336/200
JP 11-54331 * 2/1999 ..... 336/200

* cited by examiner

*Primary Examiner*—Anh Mai
(74) *Attorney, Agent, or Firm*—Keating & Bennett, LLP

(57) ABSTRACT

A multi-layered inductor array is constructed to reduce and minimize variations in the inductance values and DC resistance values of a plurality of inductors contained in a multi-layered structure. In this multi-layered inductor array, four spiral inductors having an equal number of winding turns are aligned from the left end surface of the multi-layered structure to the right end surface thereof. In the direction in which the four spiral inductors are aligned, the lengths of the spiral portions of the inductors positioned at the central portion of the multi-layered structure are greater than those of the spiral portions of the spiral inductors positioned at both end portions thereof.

20 Claims, 5 Drawing Sheets

MULTI-LAYERED INDUCTOR ARRAY

BACKGROUND OF THE INVENTION

1. Field of the Invention

The present invention relates to a multi-layered inductor array including a plurality of inductors.

2. Description of the Related Art

A conventional multi-layered inductor array 1 is shown in FIG. 5. The multi-layered inductor array 1 includes magnetic sheets 2 having coil conductors 3*a* to 6*e* provided thereon. The coil conductors 3*a* to 3*e* are electrically connected in series to each other through via-holes 12 formed in the magnetic sheets 2 to define a spiral inductor L1. Similarly, coil conductors 4*a* to 4*e*, 5*a* to 5*e*, and 6*a* to 6*e* are also electrically connected in series to each other through the via-holes 12 formed in the magnetic sheets 2 to define spiral inductors L2, L3, and L4, respectively.

The individual magnetic sheets 2, as shown in FIG. 5, are laminated together, and on the upper and lower portions of the laminated magnetic sheets 2, magnetic cover sheets (not shown) having no conductors provided on the surfaces thereof are disposed. Then, the laminated magnetic sheets 2 are integrally fired to define a multi-layered structure 15 as shown in FIG. 6. On the front and back side-surfaces of the multi-layered structure 15, external electrodes 21*a* to 24*a* and 21*b* to 24*b* of the inductors L1 to L4 are disposed, respectively.

In the multi-layered inductor array 1, to reduce the size of the inductor array 1, when the inductors L1 to L4 are arranged close to each other in the multi-layered structure 15, independence between the magnetic paths of the inductors L1 to L4 is reduced, and as a result, magnetic couplings between the inductors L1 to L4 occur. Thus, the inductors L1 to L4 in the multi-layered structure 15 have different inductance values.

As shown in FIG. 7, since the magnetic paths of the spiral inductors L1 and L4 disposed on the right and left end surfaces of the multi-layered structure 15 are narrower at the end surfaces thereof, the inductance values of the inductors L1 and L4 are reduced. To solve this problem, the number of winding turns of the spiral inductors L1 and L4 is increased as compared to that of the spiral inductors L2 and L3, and the diameters of the spiral portions of the inductors L1 and L4 are increased as compared to those of the inductors L2 and L3, to compensate for the reduction of the inductance values. However, since the lengths of the coil conductors of the inductors L1 and L4 are different from the lengths of the coil conductors of the inductors L2 and L3, the DC resistance values of the inductors L1 to L4 differ.

SUMMARY OF THE INVENTION

In order to overcome the above-described problems, preferred embodiments of the present invention provide a multi-layered inductor array that minimizes variations in the inductance values and DC resistance values of three or more inductors provided in a multi-layered structure.

According to a preferred embodiment of the present invention, a multi-layered inductor array includes a multi-layered structure defined by a laminated body of a plurality of magnetic layers and a plurality of coil conductors, at least three spiral inductors provided by electrically connecting the coil conductors to be aligned inside the multi-layered structure, and external electrodes disposed on surfaces of the multi-layered structure that are electrically connected to leading end portions of the plurality of spiral inductors. In this multi-layered inductor array, the plurality of spiral inductors have an equal number of winding turns, and, in the direction in which the spiral inductors are aligned, the lengths of the spiral portions of the inductors positioned at both end portions of the multi-layered structure shorter than the length of the spiral portion of the remaining spiral inductor.

Because magnetic paths of the spiral inductors positioned at both end portions of the multi-layered structure are narrow on the end surfaces thereof, the inductance values of the inductors is reduced. However, since the lengths of the spiral portions of these inductors positioned at both end portions of the multi-layered structure are shorter than the length of the spiral portion of the remaining inductor, the inductance values of the spiral portion of the remaining inductor is adjusted to also be reduced. Thus, variations in the inductance values between the spiral inductors are greatly suppressed.

Other features, elements, characteristics and advantages of preferred embodiments of the present invention will become apparent from the following detailed description of preferred embodiments thereof with reference to the attached drawings.

DETAILED DESCRIPTION OF PREFERRED EMBODIMENTS

Figure 1:
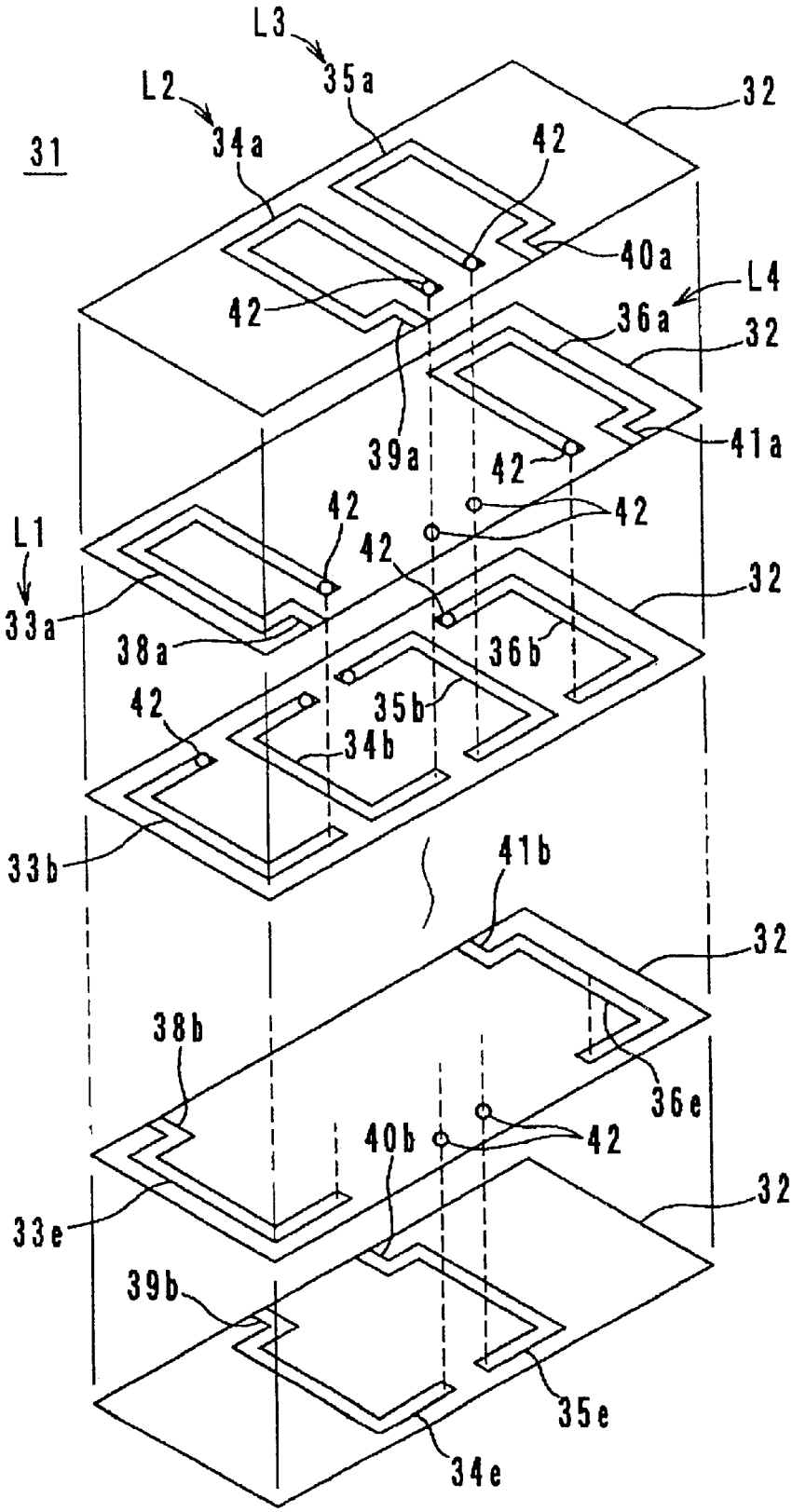
FIG. 1 is an exploded perspective view of a multi-layered inductor array according to a first preferred embodiment of the present invention.

As shown in FIG. 1, a multi-layered inductor array 31 according to a first preferred embodiment of the present invention includes substantially rectangular magnetic sheets 32 having coil conductors 34*a*, 35*a*, 33*a*, 36*a*, 33*b* to 36*b*, 33*c* to 36*c* (see FIG. 3), 33*d* to 36*d* (see FIG. 3), 33*e*, 36*e*, 34*e*, and 35*e* provided thereon. The coil conductors 33*a* to 36*e* are provided on the surfaces of the magnetic sheets 32 by printing, spattering, evaporation, or other suitable methods. The coil conductors 33*a* to 36*e* are preferably made of Ag, Ag—pd, Cu, Ni, or other suitable material. The magnetic sheets 32 preferably include a magnetic material, such as ferrite, or other suitable magnetic material.

The coil conductors 33*a* to 33*e* are electrically connected in series to each other through via-holes 42 disposed on the magnetic sheets 32 to define a spiral inductor L1 having approximately 3.5 winding turns. Similarly, the coil conductors 34*a* to 34*e*, 35*a* to 35*e*, 36*a* to 36*e* are also electrically connected in series to each other through the via-holes 42 disposed on the magnetic sheets 32 to define spiral inductors L2, L3, and L4 having approximately 3.5 winding turns.

The spiral inductors L1 and L2 are wound in a clockwise direction, while the spiral inductors L3 and L4 are wound in a counterclockwise direction. In other words, patterns of the coil conductors 33*a* to 33*e* and 34*a* to 34*e* forming the inductors L1 and L2 and patterns of the coil conductors 35*a* to 35*e* and 36*a* to 36*e* forming the inductors L3 and L4 are positioned symmetrically on the sheets 32.

An end portion of the inductor L1, that is, a leading conductor 38*a* connected to the coil conductor 33*a*, is exposed on the left side portion of the front edge portion of the sheet 32. The other end portion thereof, that is, a leading conductor 38*b* connected to the coil conductor 33*e*, is exposed on the left side portion of the back edge portion of the sheet 32. An end portion of the inductor L2, that is, a leading conductor 39*a* nnected to the coil conductor 34*a*, is exposed close to the left side of the center portion of the front edge portion of the sheet 32. The other end portion thereof, that is, a leading conductor 39*b* connected to the coil conductor 34*e*, is exposed close to the left side of the center portion of the back edge portion of the sheet 32. An end portion of the inductor L3, that is, a leading conductor 40*a* connected to the coil conductor 35*a*, is exposed close to the right side of the center portion of the front edge portion of the sheet 32. The other end portion thereof, that is, a leading conductor 40*b* connected to the coil conductor 35*e* is exposed close to the right side of the center portion of the back edge portion of the sheet 32. An end portion of the inductor L4, that is, a leading conductor 41*a* connected to the coil conductor 36*a*, is exposed on the right side portion of the front edge portion of the sheet 32, and the other end portion thereof, that is, a leading conductor 41*b* connected to the coil conductor 36*e*, is exposed on the right side portion of the back edge portion of the sheet 32.

Figure 2:
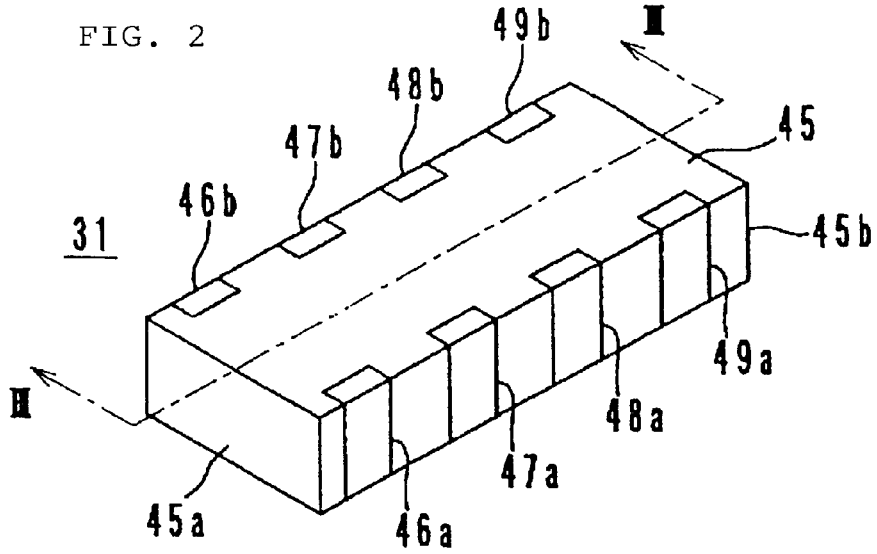
FIG. 2 is a perspective view of the appearance of the multi-layered inductor array shown in FIG. 1.

As shown in FIG. 1, the above-described magnetic sheets 32 are laminated together, and on the upper and lower portions of the laminated magnetic sheets, magnetic cover sheets (not shown) having no conductors provided thereon are disposed. Then, the laminated magnetic sheets are integrally fired to form a multi-layered structure 45 as shown in FIG. 2. On the front and back surfaces of the multi-layered structure 45, external electrodes 46*a* to 49*a* and 46*b* to 49*b* of the inductors L1 to L4 are provided. The external electrodes 46*a* to 49*a* are electrically connected to the leading conductors 38*a* to 41*a* on the one side portion of the inductors L1 to L4. The external electrodes 46*b* to 49*b* are electrically connected to the leading conductors 38*b* to 41*b* on the other side portion of the inductors L1 to L4. The external electrodes 46*a* to 49*a* and 46*b* to 49*b* are provided by firing or wet-plating after applying a conductive paste material such as Ag, Ag—Pd, Cu, Ni or other suitable material.

Figure 3:
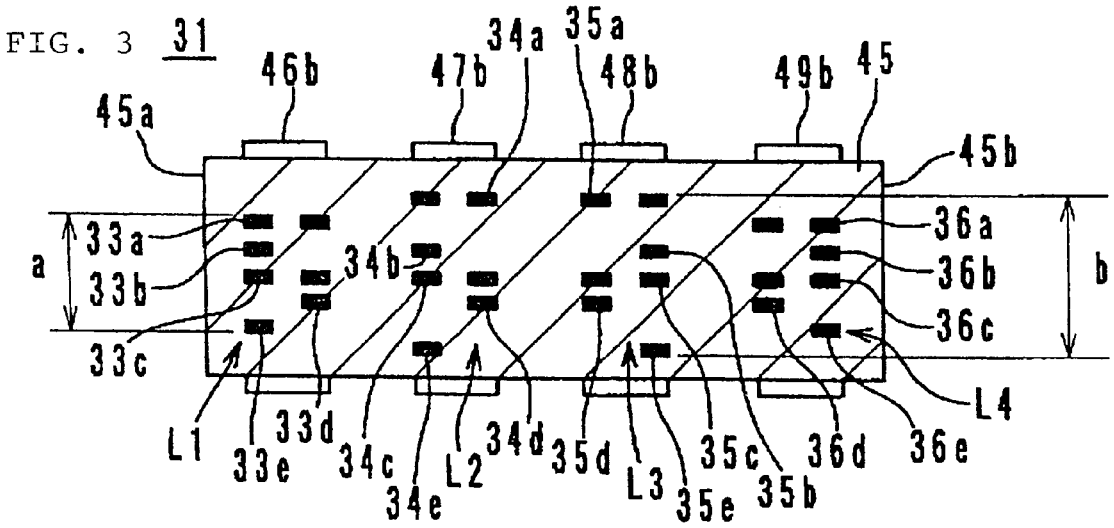
FIG. 3 is a sectional view taken along line III—III in the multi-layered inductor array shown in FIG. 2.

In the multi-layered inductor array 31 as shown in FIG. 3, the four spiral inductors L1 to L4 are aligned from the left end surface 45*a* to the right end surface 45*b* inside the multi-layered structure 45. In the direction in which the spiral inductors L1 to L4 are aligned, the lengths b of the spiral portions of the inductors L2 and L3 positioned at the central portion of the multi-layered structure 45 are greater than the lengths a of the spiral portions of the inductors L1 and L4 positioned at the left and right end portions of the multi-layered structure 45. When the lengths of the spiral parts of the inductors are increased while the numbers of winding turns thereof are equal, the leakage fluxes of the inductors are greatly increased, thus the inductance values thereof are greatly reduced.

The effective area of the magnetic path of the spiral inductor L1 is reduced on the left end surface 45*a* of the multi-layered structure 45. The effective area of the magnetic path of the spiral inductor L4 is reduced on the right end surface 45*b* of the multi-layered structure 45. As a result, the inductance value of each of the inductors L1 and L4 is greatly reduced. When the lengths b of the spiral portions of the inductors L2 and L3 are greater than the lengths a of the spiral portions of the inductors L1 and L4, the inductance-lowering rate of the inductors L2 and L3 is substantially equal to the inductance-lowering rate of the inductors L1 and L4. As a result, in the multi-layered inductor array 31, variations in the inductance values of the inductors L1 to L4 are greatly reduced.

The inductance-lowering rate of the spiral inductors L2 and L3 can be adjusted by varying the thickness of the magnetic sheet 32 having the coil conductors 34*a* and 35*a* provided thereon and the thickness of the magnetic sheet 32 having the coil conductors 33*e* and 36*e* provided thereon. With this arrangement, variations in the inductance values are easily adjusted. In addition, it is not necessary to provide an additional coil conductor pattern in an inductor array and to prepare a jig such as a molding metal die for a via-hole 42.

Furthermore, it is not necessary to change the diameter of the coil and the number of winding turns of the coil in each of the inductors L1 to L4, and the lengths of the coil conductors of the inductors L1 to L4 are substantially equal. Thus, the DC resistance values of the inductors L1 to L4 do not differ.

Figure 4:
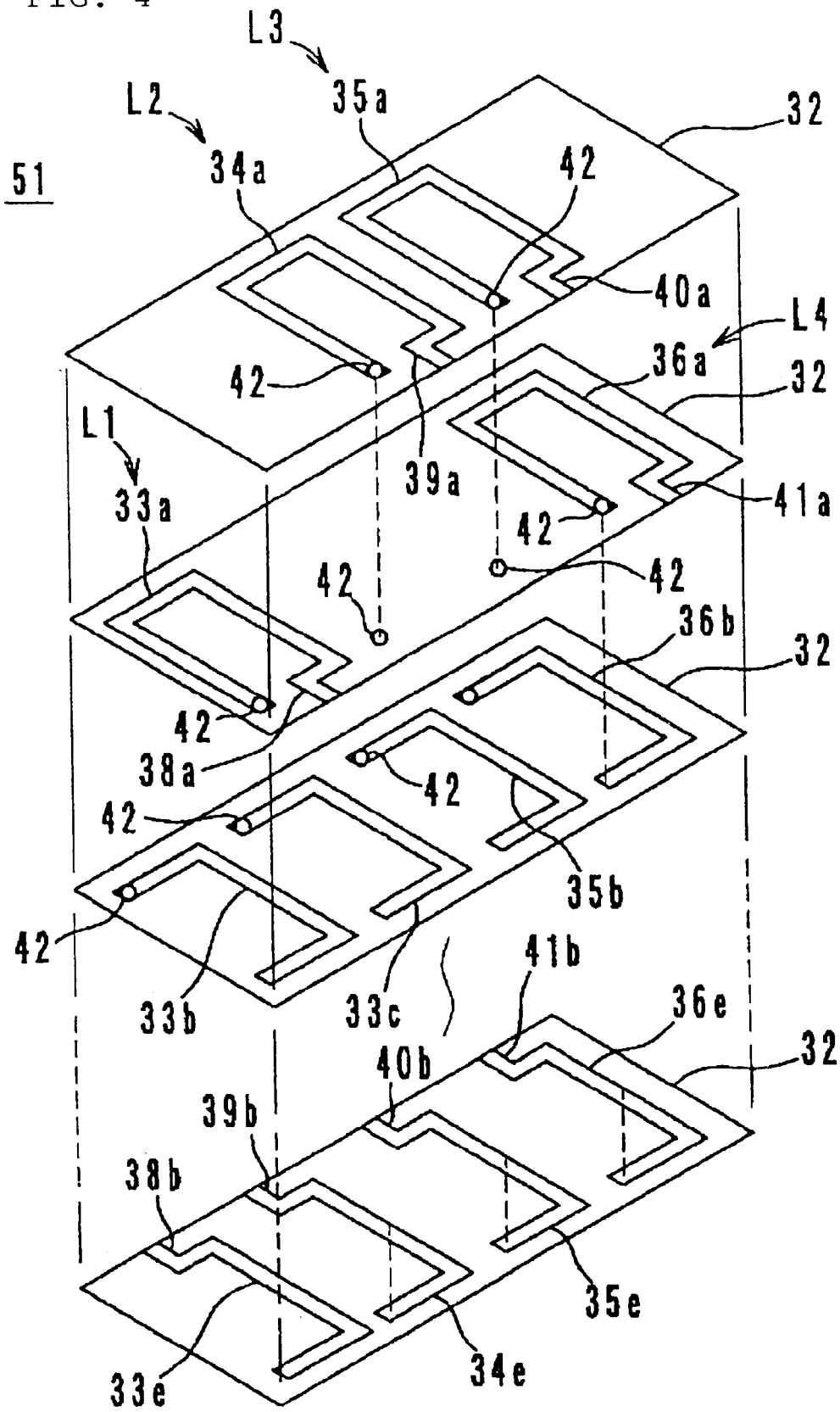
FIG. 4 is an exploded perspective view of a multi-layered inductor array according to a second preferred embodiment of the present invention.

As shown in FIG. 4, a multi-layered inductor array 51 in accordance with a second preferred embodiment of the present invention has substantially the same structure as the multi-layered inductor array 31 shown in FIGS. 1 to 3, in which the coil conductors 33*a* to 33*e*, 34*a* to 34*e*, 35*a* to 35*e*, and 36*a* to 36*e* defining the inductors L1, L2, L3, and L4, respectively, are arranged in the same direction on the sheets 32. However, in the multi-layered inductor array 51 of the second preferred embodiment, the coil conductors 33*e* to 36*e* are provided on the same magnetic sheet 32. In other words, in the inductor array 51, the coil conductors 34*a* and 35*a* positioned on the upper portions of the inductors L2 and L3 are provided on a different magnetic sheet 32 from that on which the coil conductors 33*a* and 36*a* are provided. With this arrangement, the lengths b of the spiral portions of the inductors L2 and L3 are greater than the lengths a of the spiral portions of the inductors L1 and L4. However, alternatively, the lengths b may be greater than the lengths a by providing the coil conductors 33*a* to 36*a* on the same magnetic sheet 32 while providing the coil conductors 34*e* and 35*e* on the lower portions of the inductors L2 and L3 on a different sheet 32 from that on which the coil conductors 33*e* and 36*e* are provided.

The multi-layered inductor array 51 provides the same effects and advantages as those obtained in the multi-layered inductor array 31 according to the first preferred embodiment. In addition, the coil conductors 33*a* to 36*e* having the same configuration are arranged on the same sheet 32, and via-holes 42 are provided at substantially equal distances. As a result, when the via-holes 42 are provided by a molding metal die or other suitable device, it is not necessary to determine the limit value of the distance between the via-holes 42 when forming the via-holes 42. Therefore, unlike via-holes that are not formed at equal distances, the present invention produces much smaller inductor arrays. Moreover, since the coil conductors 33*a* to 36*e* having the same configuration are arranged, when the coil conductors 33*a* to 36*e* are printed on the same sheet 32, variations of printing, such as spreading or deviations are greatly reduced between the coil conductors 33*e* to 36*e*.

The multi-layered inductor array in accordance with the present invention is not restricted to the above-described preferred embodiments. Various modifications and changes can be made within the scope of the invention. For example, the number of inductors contained in the multi-layered structure may be three, five, or more.

Furthermore, in the above-described preferred embodiments, although magnetic sheets having patterns provided thereon are laminated to be integrally fired, the magnetic sheets may be fired in advance before being laminated. In addition, the inductor array of the present invention may be produced by a method, which will be described as follows. After providing a magnetic layer formed of a paste magnetic material by printing or other suitable method, on a surface of the magnetic layer, a paste conductive pattern is applied to form an arbitrary pattern. Then, on the arbitrary pattern, the paste magnetic material is again applied to form a magnetic layer containing the pattern. Similarly, by repeating the application procedures in sequence, an inductor array having a multi-layered structure is obtained.

Figure 5:
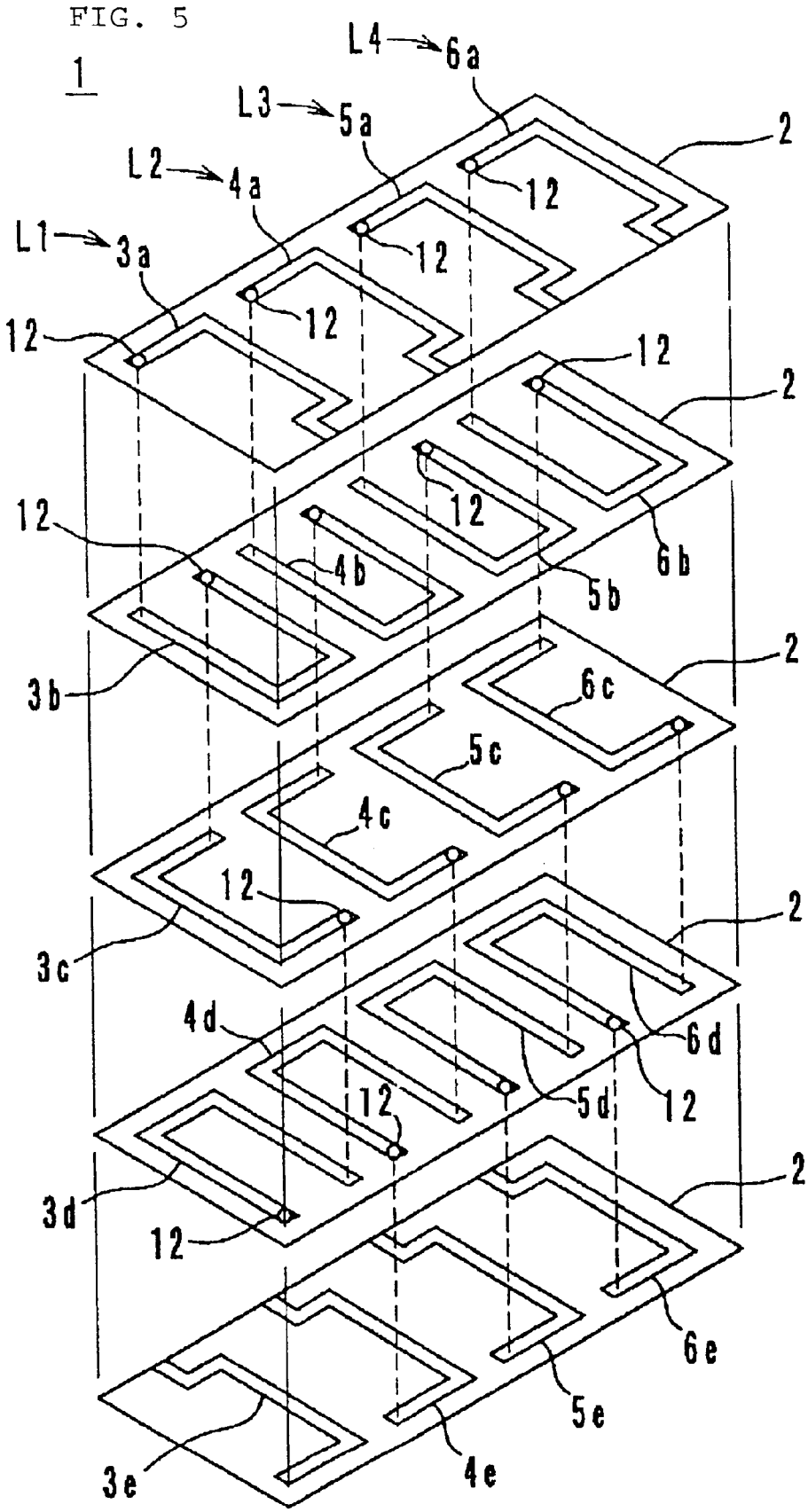
FIG. 5 is an exploded perspective view showing the structure of a conventional multi-layered inductor array.
Figure 6:
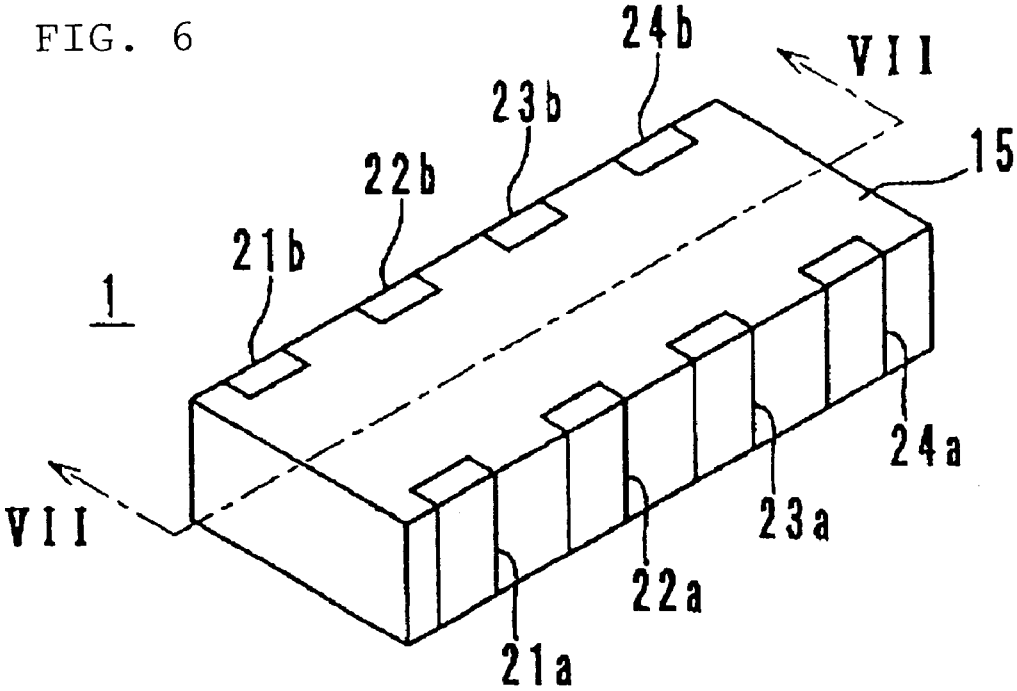
FIG. 6 is a perspective view of the appearance of the multi-layered inductor array shown in FIG. 5.
Figure 7:
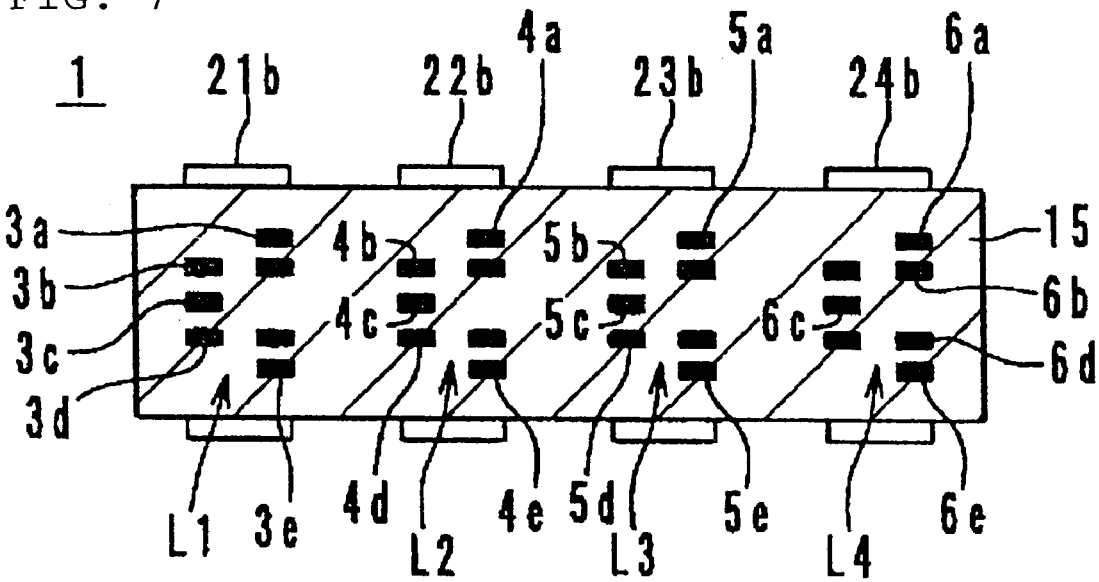
FIG. 7 is a sectional view taken along line VII—VII in the multi-layered inductor array shown in FIG. 6.

Under the conditions described below, Table 1 shows variations in the inductance values of the multi-layered inductor array 31 (sample A) shown in FIGS. 1 to 3. Table 1 also shows variations in the inductance values of the conventional multi-layered inductor array 1 shown in FIGS. 5 to 7 for comparison. In the conventional example and the sample A shown in Table 1, trial models having spiral inductors with different numbers of winding turns were produced, and the inductance values of the models were measured to be corrected under the condition of 3.5 turns as the number of winding turns.

Dimensions of chip: 3.2 mm×1.6 mm×0.8 mm

Pattern width of coil conductor: 120μm (when printed)

Thickness of coil conductor: 15 μm (when printed)

Thickness of magnetic sheet: 50 μm (when printed)

TABLE 1

| | INDUCTANCE VALUE AT 1 MHz (μH) | | | | VARIATION IN INDUCTANCE |
|---|---|---|---|---|---|
| | L1 | L2 | L3 | L4 | VALUE (%) |
| SAMPLE A | 1.578 | 1.593 | 1.593 | 1.568 | 1.6 |
| CONVENTIONAL EXAMPLE | 1.574 | 1.779 | 1.778 | 1.570 | 12.5 |

In Table 1, the variations in the inductance values were obtained by the following formula:

$$\{(Lmax-Lmin)/Lx\}\times 100$$

Lmax: maximum inductance value

Lmin: minimum inductance value

Lx: inductance average value

Table 1 shows that the variation in the inductance values of the sample A is greatly reduced as compared to the inductance values of the conventional example.

As described above, according to various preferred embodiments of the present invention, when the lengths of the spiral portions of the inductors positioned at both end portions of the multi-layered structure are less than the length of the spiral portion of the remaining inductor, the inductance value of the remaining inductor is greatly reduced. As a result, the inductance-lowering rate of the remaining spiral inductor is substantially equal to the inductance-lowering rate of the spiral inductors positioned at both end portions of the multi-layered structure. With this arrangement, variations in the inductance values of three or more inductors disposed in the multi-layered structure having limited dimensions are greatly reduced. Moreover, since the lengths of the coil conductors and the pattern widths of the inductors do not differ, variations in the DC resistances of the inductors are increased.

It should be understood that the foregoing description is only illustrative of preferred embodiments of the present invention. Various alternatives and modifications can be devised by those skilled in the art without departing from the present invention. Accordingly, the present invention is intended to embrace all such alternatives, modifications and variations that fall within the scope of the appended claims.

What is claimed is:

1. A multi-layered inductor array comprising:

a multi-layered structure including a plurality of magnetic layers and a plurality of coil conductors;

at least three spiral inductors having spiral portions and defined by the coil conductors being electrically connected to each other and aligned in the multi-layered structure; and external electrodes disposed on surfaces of the multi-layered structure to be electrically connected to leading end portions of the at least three spiral inductors; wherein each of the at least three spiral inductors have an equal number of winding turns, and the lengths of the spiral portions of the at least three spiral inductors positioned at both end portions of the multi-layered structure are less than the length of the spiral portion of the remaining inductors of said at least three spiral inductors in the direction in which the spiral inductors are aligned.

2. A multi-layered inductor array according to claim 1, wherein said coil conductors of said at least three spiral inductors are electrically connected to each other through via holes provided in the magnetic sheets.

3. A multi-layered inductor array according to claim 2, wherein said via holes are disposed at equal intervals on said magnetic sheets.

4. A multi-layered inductor array according to claim 1, wherein each of said at least three spiral inductors includes approximately 3.5 turns.

5. A multi-layered inductor array according to claim 1, wherein each of said at least three spiral inductors includes a leading end portion exposed at a front side portion of the multi-layered structure, and a leading end portion exposed at a back side portion of the multi-layered structure.

6. A multi-layered inductor array according to claim 1, further including magnetic cover sheets disposed on upper and lower surfaces of said multi-layered structure.

7. A multi-layered inductor array according to claim 6, wherein said magnetic cover sheets do not have inductors provided thereon.

8. A multi-layered inductor array according to claim 1, wherein said at least three spiral inductors includes four spiral inductors.

9. A multi-layered inductor array according to claim 1, wherein the spiral inductors positioned at both end portions of the multi-layered structure are wound in opposite directions.

10. A multi-layered inductor array according to claim 1, wherein said plurality of magnetic layers defined a laminated body.

11. A multi-layered inductor array comprising:

a plurality of magnetic layers having a plurality of coil conductors provided thereon, and stacked in a vertical direction;

at least three spiral inductors defined by coil conductors of the plurality of coil conductors being electrically connected and aligned in the vertical direction; and external electrodes disposed on surfaces of the stacked magnetic layers to be electrically connected to leading end portions of the plurality of spiral inductors; wherein each of the at least three spiral inductors have an equal number of winding turns, and the lengths of the spiral portions of the at least three spiral inductors positioned at both end portions of the multi-layered inductor array are less than the length of the spiral portion of the remaining inductors of said at least three spiral inductors in the vertical direction.

12. A multi-layered inductor array according to claim 11, wherein said coil conductors of said at least three spiral inductors are electrically connected to each other through via holes provided in the plurality of magnetic sheets.

13. A multi-layered inductor array according to claim 12, wherein said via holes are disposed at equal intervals on said plurality of magnetic sheets.

14. A multi-layered inductor array according to claim 11, wherein each of said at least three spiral inductors includes approximately 3.5 turns.

15. A multi-layered inductor array according to claim 11, wherein each of said at least three spiral inductors includes a leading end portion exposed at a front side portion of the multi-layered inductor array, and a leading end portion exposed at a back side portion of the multi-layered inductor array.

16. A multi-layered inductor array according to claim 11, further including magnetic cover sheets disposed on upper and lower surfaces of said stacked magnetic layers.

17. A multi-layered inductor array according to claim 16, wherein said magnetic cover sheets do not have inductors thereon.

18. A multi-layered inductor array according to claim 11, wherein said at least three spiral inductors includes four spiral inductors.

19. A multi-layered inductor array according to claim 11, wherein the spiral inductors positioned at both end portions of the multi-layered inductor array are wound in opposite directions.

20. A multi-layered inductor array according to claim 11, wherein said plurality of magnetic layers define a laminated body.

* * * * *